US006589577B2

(12) United States Patent
Lazaris et al.

(10) Patent No.: US 6,589,577 B2
(45) Date of Patent: Jul. 8, 2003

(54) DISPOSABLE SINGLE SERVE BEVERAGE FILTER CARTRIDGE

(75) Inventors: Nicholas G. Lazaris, Newton, MA (US); William P. Bucuzzo, Haverhill, MA (US)

(73) Assignee: Keurig, Inc., Wakefield, MA (US)

( * ) Notice: Subject to any disclaimer, the term of this patent is extended or adjusted under 35 U.S.C. 154(b) by 93 days.

(21) Appl. No.: 09/782,660

(22) Filed: Feb. 13, 2001

(65) Prior Publication Data

US 2001/0047724 A1 Dec. 6, 2001

Related U.S. Application Data

(60) Provisional application No. 60/183,606, filed on Feb. 18, 2000.

(51) Int. Cl.[7] ..... A47G 19/16; B65D 85/816

(52) U.S. Cl. ..... 426/79; 426/113; 426/115; 99/295; 99/323; 206/0.5; 210/455; 210/473

(58) Field of Search ..... 99/295, 316, 317, 99/323, 321, 322; 426/79, 81, 112, 113, 433, 435, 115; 206/0.5; 210/455, 473

(56) References Cited

U.S. PATENT DOCUMENTS

| | | | | |
|---|---|---|---|---|
| 4,550,024 A | | 10/1985 | le Granse | 426/77 |
| 5,075,005 A | * | 12/1991 | Brindopke | 210/477 |
| 5,242,702 A | * | 9/1993 | Fond | 426/433 |
| 5,243,164 A | * | 9/1993 | Erickson et al. | 219/10.55 E |
| 5,605,710 A | * | 2/1997 | Pridonoff et al. | 426/86 |
| 5,840,189 A | | 11/1998 | Sylvan et al. | 210/474 |

FOREIGN PATENT DOCUMENTS

| | | | |
|---|---|---|---|
| DE | 8609418 | | 5/1986 |
| EP | 1101430 A1 | * | 5/2001 |
| FR | 2118368 | | 7/1972 |
| GB | 1427375 | * | 3/1976 |
| GB | 2023086 A | * | 12/1979 |
| NL | 8701627 | * | 7/1987 |

* cited by examiner

*Primary Examiner*—Keith Hendricks
*Assistant Examiner*—Drew Becker
(74) *Attorney, Agent, or Firm*—Samuels, Gauthier & Stevens

(57) ABSTRACT

A beverage filter cartridge includes an outer container with a bottom, and front, back and side walls extending upwardly from the bottom to a peripheral rim surrounding an upper opening. The side wall is contoured to define interior ledges located above the bottom and extending between the front and back walls. A planar filter element having front, back and side edge regions is configured, dimensioned and positioned to subdivide the interior of the container into first and second chambers, with the front and back edge regions of the filter element secured respectively to the front and back walls of the container, and with side edge regions of the filter element secured to respective interior ledges of the container side walls. A beverage medium is stored in the first chamber. A cover is joined to the container rim to close the upper opening. The cover is yieldably piercable to accommodate an inflow of liquid into the first chamber for combination with the beverage medium to produce a beverage. The filter element is permeable to accommodate passage of the beverage from the first chamber into the second chamber, and the container bottom is yieldably piercable to accommodate an outflow of the beverage from the second chamber to the exterior of the cartridge.

13 Claims, 3 Drawing Sheets

DISPOSABLE SINGLE SERVE BEVERAGE FILTER CARTRIDGE

CROSS REFERENCES TO RELATED APPLICATIONS

This application claims priority from Provisional Patent Application Serial No. 60/183,606 filed Feb. 18, 2000.

FIELD OF THE INVENTION

This invention relates to disposable single serve beverage filter cartridges.

DESCRIPTION OF THE PRIOR ART

A known disposable single serve beverage filter cartridge is disclosed in U.S. Pat. Nos. 5,325,765 and 5,840,189 (Sylvan et al), dated respectively Jul. 5, 1994 and Nov. 24, 1998. This beverage filter cartridge is comprised basically of an impermeable yieldably piercable cup-shaped container internally subdivided by a permeable cone-shaped filter into first and second chambers. A granular or powered dry beverage medium, e.g., roasted ground coffee, is stored in the first chamber, and the container is closed by an impermeable yieldably piercable lid.

During a brewing cycle, the lid and container bottom are pierced, respectively, by tubular inlet and outlet probes. The inlet probe admits heated liquid into the first chamber for infusion with the beverage medium, and the resulting brewed beverage passes through the filter into the second chamber from which it exits via the outlet probe for delivery to an underlying cup.

This known beverage filter cartridge has gained rapid and increasingly widespread acceptance, notwithstanding certain problems and disadvantages relating to its production and subsequent use that have persisted since its initial introduction.

For example, expensive and mechanically complex production equipment is required both to form the cone-shaped filter from a sheet of filter media, and to insert and secure the thus formed filter cone in the cartridge container. Slight deviations from close tolerances governing these steps can cause the filter to rupture or become dislodged from the container wall during the brewing cycle, resulting in contamination of the brewed beverage with beverage medium residue from the first chamber.

Because of its cone-shaped configuration, the filter has a limited extract storage capacity of less than 60% of the internal volume of the cup-shaped container. The unoccupied volume surrounding the filter component, commonly referred to as "head space", is largely wasted and thus adds disadvantageously to the overall size of the beverage filter cartridge. The additional head space also increases the likelihood of residual oxygen being left in the container, thus adversely affecting product shelf life. The cone-shaped configuration of the filter also limits the area available for lid puncture and inflow of liquid for infusion with the beverage medium.

Also, the side wall of the cup-shaped container is relatively pliable and thus prone to buckling as the brewer probes puncture the container bottom and lid at the onset of the brewing cycle. This can adversely affect the puncturing process, resulting in leakage around the probes.

What is needed, therefore, is an improved beverage filter cartridge which obviates or at least significantly minimizes the above-noted problems and disadvantages.

SUMMARY OF THE INVENTION

In accordance with the present invention, a beverage filter cartridge includes an outer container having a bottom with front, back and side walls extending upwardly to a peripheral rim surrounding an upper opening. The side walls are suitably contoured to minimize headspace, increase rigidity, and to define interior filter-supporting ledges located above the bottom and extending between the front and back walls. A planar filter element subdivides the interior of the container into first and second chambers, with the first chamber having a volumetric storage capacity of at least about 80% of the total internal volume of the outer container. Front and back edge regions of the filter element are secured respectively to the front and back walls of the container, and edge regions of the filter component are likewise secured to the interior ledges of the container side walls.

A beverage medium is stored in the first chamber, and a lid is applied to the peripheral container rim to seal off the upper opening.

The planer filter element is readily formed from a sheet of filter media, and is easily inserted and secured in place. The front and back container walls and the interior ledges of the side walls offer ample support surfaces against which edge regions of the filter element may be reliable secured. The contoured container side walls contribute advantageously to a heightened rigidity which beneficially resists buckling when the lid and container bottom are pierced at the onset of a brewing cycle.

The relatively large volume of the first chamber as compared to the second chamber translates into a more efficient package, making it possible to either increase the amount of beverage medium for a given overall cartridge size, or conversely, for a given amount of beverage medium, to decrease the overall cartridge size.

These and other features and advantages of the present invention will now be described in greater detail with reference to the accompanying drawings, wherein:

DETAILED DESCRIPTION

Figures 1, 2:
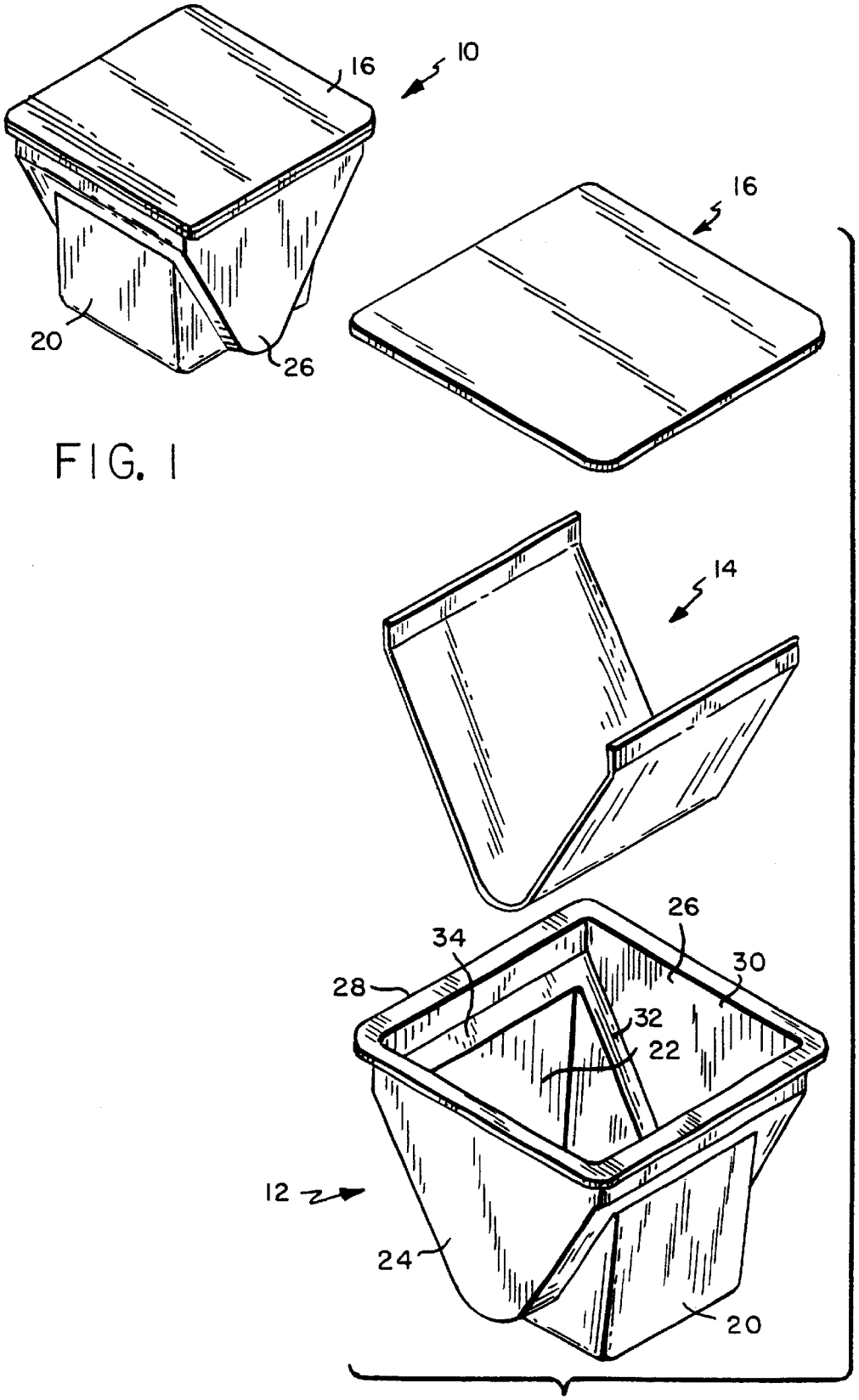
FIG. 1 is a perspective view of a beverage filter cartridge in accordance with the present invention.
FIG. 2 is a larger scale exploded perspective view of the component parts of the beverage filter cartridge.
Figure 3:
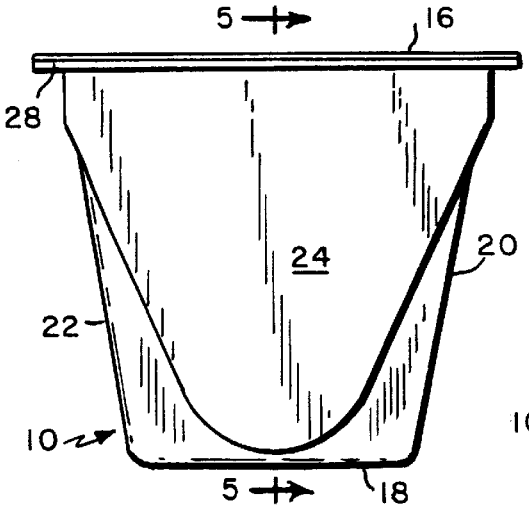
FIG. 3 is a front elevational view of the beverage filter cartridge, the rear view being a mirror image of this view.

With reference to the drawings, a beverage filter cartridge in accordance with the present invention is generally depicted at 10. The cartridge components are illustrated separately in FIG. 2, and include: an outer container 12, a planar filter element 14, and a lid 16.

The container 10 has a bottom wall 18, a front wall 20, a back wall 22, and side walls 24, 26. The front, back and side walls extend upwardly from the bottom wall to a peripheral rim 28 surrounding an upper opening 30.

Figure 8:
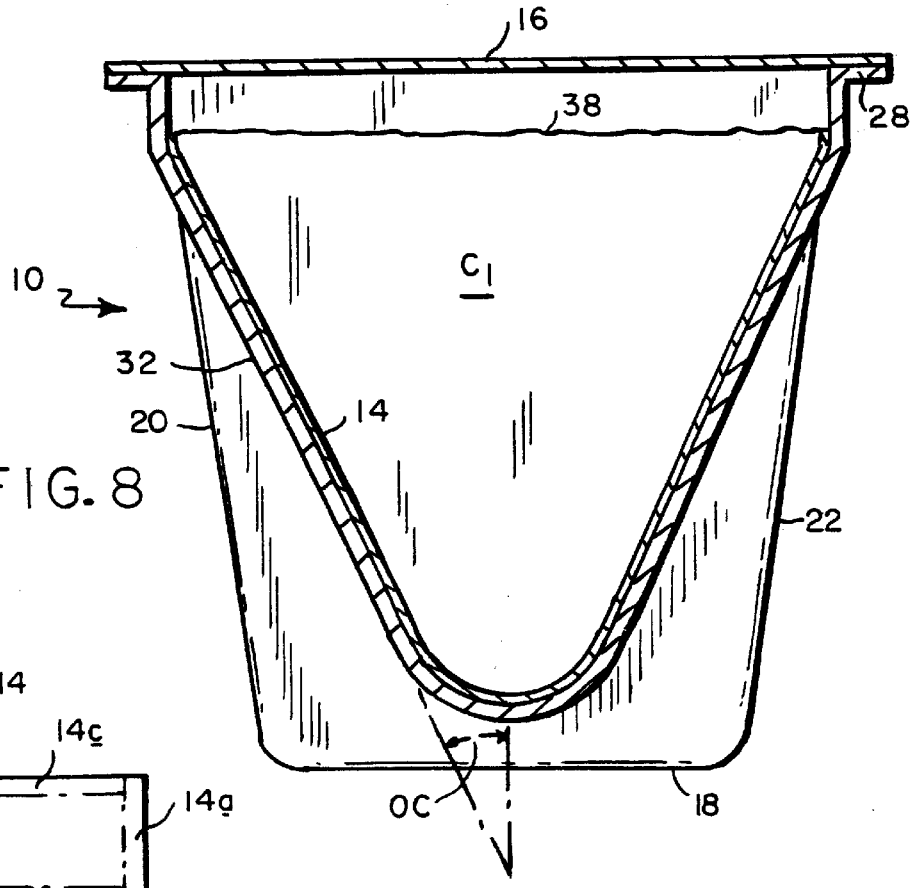
FIG. 8 is an enlarged sectional view taken along line 8—8 of FIG. 4.

The side walls 24, 26 are appropriately contoured to define generally V-shaped first ledges 32 extending between the front and back walls 20, 22, with the lower portions of the ledges 32 being spaced above the container bottom 18, and the sides diverging upwardly at an angle $\alpha$ with respect to the vertical, as shown in FIG. 8.

Figure 4:
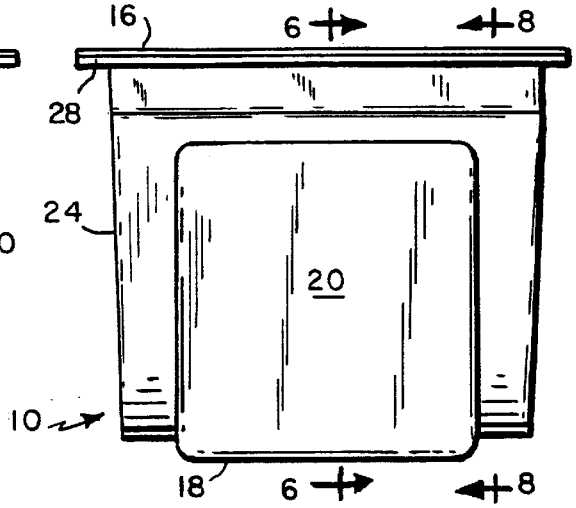
FIG. 4 is a side elevational view of the beverage filter cartridge, the opposite side being a mirror image of this view.
Figure 5:
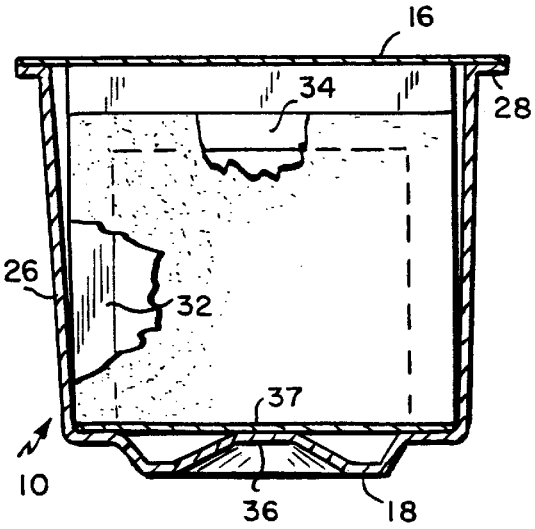
FIG. 5 is a vertical sectional view taken along line 5—5 of FIG. 3.
Figure 6:
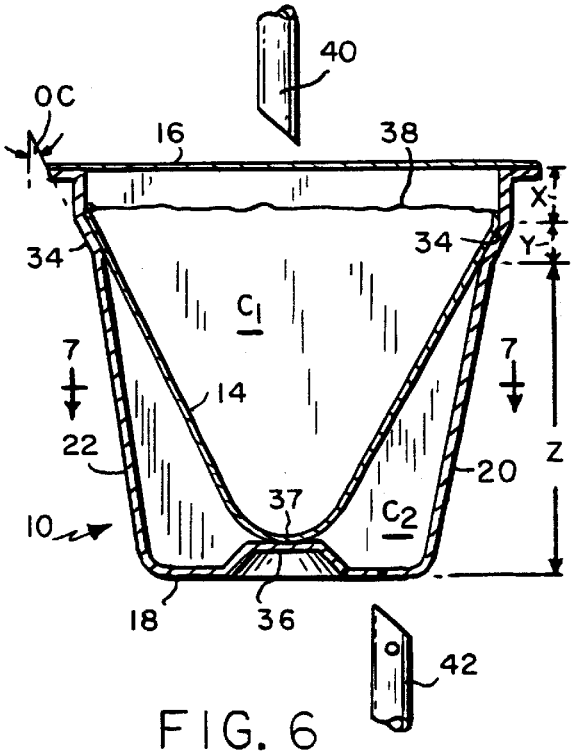
FIG. 6 is a vertical sectional view taken along line 6—6 of FIG. 4.
Figure 7:
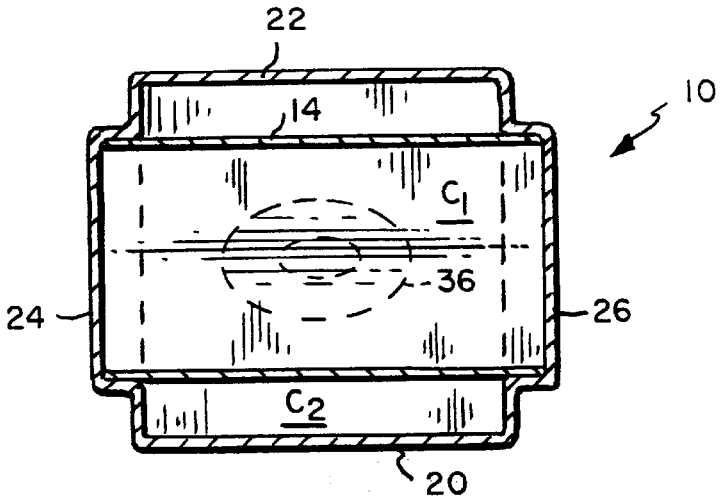
FIG. 7 is a horizontal sectional view taken along line 7—7 of FIG. 6.

As shown in FIGS. 4 and 6, the front and back walls 20, 22 have upper sections "X", intermediate sections "Y", and lower sections "Z". The intermediate sections Y define second ledges 34 which diverge upwardly at the same angle $\alpha$ to thereby provide continuations of the first ledges 32 extending across the front and back walls 20, 22.

The bottom 18 is preferably contoured to provide an upwardly protruding centrally located boss 36.

The container may be formed from impermeable yieldably piercable and heat sealable materials, a preferred example being polyethylene/EVOH/polystyrene supplied by Curwood Flexible Packaging of Oshkosh, Wis., USA.

The filter element 14 may be cut or blanked from any suitably pliable and permeable sheet material, a preferred example being cellulose polypropylene supplied by J. P. Crompton, Ltd. of Bury, Laucashine, England.

Figure 9:
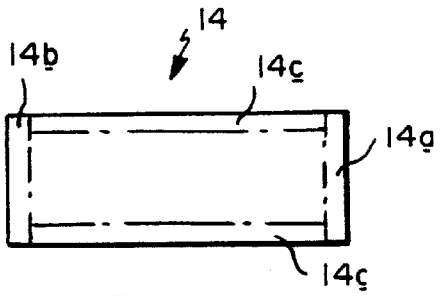
FIG. 9 is a plan view on a reduced scale of the filter element prior to its insertion in the cup-shaped container.

As shown in FIG. 9, the filter element has front, back and side edge regions 14*a*, 14*b* and 14*c*. The filter element is configured, dimensioned and operatively positioned to subdivide the interior of the container into first and second chambers $C_1$, $C_2$, with the volume of the first chamber $C_1$ comprising at least about 80% of the internal volume of the container 12. When thus positioned, it will be understood that the side edge regions 14*c* of the filter element are secured as by heat sealing to the first ledges 32 of the side walls 24, 26, and the front and back edge regions 14*a*, 14*b* are similarly secured to the second ledges 34 of the front and back walls 20, 22. Preferably, the bottom of the filter element is also secured as by heat sealing as at 37 to the upwardly protruding boss 36.

A beverage extract 38 (shown only in FIGS. 6 and 8) is received through the upper opening 30 and stored in the first chamber $C_1$. The upper opening is then closed by securing the lid 16, as by heat sealing, to the peripheral container rim 28. The lid may be cut or blanked from any suitable impermeable heat sealable and yieldably piercable material, a preferred example being a metallic/polymer laminate supplied by Heat Seal-Winpak, Ltd. of Montreal, Canada.

At the onset of a brewing cycle, as shown in FIG. 6, the lid 16 and container bottom 18 are pierced, respectively, by tubular inlet and outlet probes 40, 42. The inlet probe admits heated liquid into the first chamber $C_1$ for infusion with the beverage medium 38. The resulting brewed beverage passes through the filter element 14 into the second chamber $C_2$ from which it exits via the outlet probe 42.

In light of the foregoing, it will now be appreciated by those skilled in the art that the present invention offers a number of significant advantages over the known beverage filter cartridge described previously. For example, the planar filter element 14 lends itself to being readily blanked from sheet material and easily configured, inserted and secured in place in the container 12. The container ledges 32 and 34 provide relatively wide and readily accessible surfaces onto which edge regions of the filter element can be securely heat sealed. The large volume of the extract storage chamber $C_1$ maximizes efficient utilization of the container interior. The contoured side walls 24, 26 lend rigidity to the overall structure and in so doing, resist buckling as the lid and container bottom are pierced by inlet and outlet probes.

The cartridge container is designed to maintain a controlled atmosphere of $N_2$, $C_2$ or other gas introduced during the manufacturing process. Once sealed, the container will withstand an induced vacuum of at least 22" Hg for a prescribed period and will remain serviceable and protect the beverage medium contained in the storage chamber $C_1$.

Although the outer container and lid have been described as being formed from impermeable materials, it will be understood by those skilled in the art that, alternatively, permeable materials may be employed for one or both of these components. Where permeable materials are employed, the completed cartridges will preferably be subsequently enclosed, either individually or in batches, with impermeable wrappings. Materials for such wrappings are well known, and include for example EVOH films, aluminum foil, etc.

Although the present invention had been shown and described with respect to a preferred embodiment, various changes and modifications that are obvious to a person skilled in the art to which the invention pertains, even if not shown or specifically described herein, are deemed to lie within the spirit and scope of the present invention. Any numbering of the elements of the following claims is merely for convenience and is not intended to suggest that the ordering of the elements of the claims has particular significance other than as otherwise expressed by the language of the claims.

What is claimed is:

1. A beverage filter cartridge comprising:

an outer container having a bottom and front, back and side walls extending upwardly from said bottom to a peripheral rim surrounding an upper opening, said side walls being contoured to define interior ledges located above and diverging upwardly from said bottom to extend between said front and back walls;

a planar filter element having front, back and side edge regions, said filter element being formed into a generally pocket shaped configuration defining a cavity, and being positioned to subdivide the interior of said container into first and second chambers, with said front and back edge regions secured respectively to said front and back walls, and with said side edge regions secured to respective interior ledges of said side walls, said second chamber being located externally of said first chamber, and said first chamber being at least partially defined by the cavity of said filter element;

a beverage medium received in said cavity for storage in said first chamber; and a cover joined to said rim and closing said upper opening, said cover being piercable to accommodate an inflow of liquid into said first chamber for combination with the beverage medium to produce a beverage, said filter element being permeable to accommodate a flow of said beverage from said first chamber into said second chamber, and said bottom being piercable to accommodate an outflow of said beverage from said second chamber to the exterior of said cartridge.

2. The beverage filter cartridge of claim 1 wherein said interior ledges are generally V-shaped.

3. The beverage filter cartridge of claims 1 or 2 wherein said front and back walls have upper sections extending downwardly from said peripheral rim to intermediate sections, and lower sections extending downwardly from said intermediate sections to said bottom.

4. The beverage filter cartridge of claim 3 wherein said intermediate sections define second ledges joining said upper and lower sections.

5. The beverage filter cartridge of claim 4 wherein said second ledges taper inwardly from said upper sections to said lower sections.

6. The beverage filter cartridge of claim 3 wherein the front and back edge regions of said filter element are joined respectively to the intermediate sections of said front and back walls.

7. The beverage filter cartridge of claim 1 further comprising a central boss on said bottom, said boss projecting into the interior of said container and into contact with said filter element.

8. The beverage filter cartridge of claim 1 wherein the volume of said first chamber is at least about 80% of the volume of said container.

9. The beverage filter cartridge of claim 1 wherein said outer container is impermeable to liquids and gases.

10. The beverage filter cartridge of claims 1 or 9 wherein said cover is impermeable to liquids and gases.

11. A beverage filter cartridge comprising:

an outer container having a bottom and front, back and side walls extending upwardly from said bottom to a peripheral rim surrounding an upper opening, said side walls being contoured to define interior first ledges located above and diverging upwardly from said bottom to extend between said front and back walls, said first ledges being generally V-shaped and having sides diverging upwardly at an angle $\alpha$, said front and back walls having upper sections extending downwardly from said peripheral rim to intermediate sections, and lower sections extending downwardly from said intermediate sections to said bottom, said intermediate sections diverging upwardly at said angle $\alpha$ to define second ledges;

a planar filter element having front, back and side edge regions, said filter element being formed into a generally pocket shaped configuration defining a cavity, and being positioned to subdivide the interior of said container into first and second chambers, with said front and back edge regions secured respectively to said second ledges, and with said side edge regions secured to respective first ledges of said side walls, said second chamber being located externally of said first chamber, and said first chamber being at least partially defined by the cavity of said filter element;

a beverage medium received in said cavity for storage in said first chamber; and a cover joined to said rim and closing said upper opening, said cover being piercable to accommodate an inflow of liquid into said first chamber for combination with the beverage medium to produce a beverage, said filter element being permeable to accommodate a flow of said beverage from said first chamber into said second chamber, and said bottom being piercable to accommodate an outflow of said beverage from said second chamber to the exterior of said cartridge.

12. A beverage filter cartridge comprising:

an outer container having a bottom and front, back and side walls extending upwardly from said bottom to a peripheral rim surrounding an upper opening, said side walls being contoured to define interior ledges located above and diverging upwardly from said bottom to extend between said front and back walls;

a planar filter element having front, back and side edge regions, said filter element being formed into a generally pocket shaped configuration defining a cavity, and being positioned to subdivide the interior of said container into first and second chambers, the volume of said first chamber being at least about 80% of the volume of said container, the front and back edge regions of said filter element being secured respectively to said front and back walls, and the side edge regions of said filter element being secured to respective interior ledges of said side walls, said second chamber being located externally of said first chamber, and said first chamber being at least partially defined by the cavity of said filter element;

a beverage medium received in said cavity for storage in said first chamber; and a cover joined to said rim and closing said upper opening, said cover being piercable to accommodate an inflow of liquid into said first chamber for combination with the beverage medium to produce a beverage, said filter element being permeable to accommodate a flow of said beverage from said first chamber into said second chamber, and said bottom being piercable to accommodate an outflow of said beverage from said second chamber to the exterior of said cartridge.

13. A beverage filter cartridge comprising:

an outer container having a bottom and front, back and side walls extending upwardly from said bottom to a peripheral rim surrounding an upper opening, said side walls being contoured to define interior ledges located above and diverging upwardly from said bottom to extend between said front and back walls, said bottom having a central boss projecting upwardly into the interior of said container;

a planar filter element having front, back and side edge regions, said filter element having a generally pocket shaped configuration forming a cavity and being positioned to subdivide the interior of said container into first and second chambers, with said front and back edge regions secured respectively to said front and back walls, and with said side edge regions secured to respective interior ledges of said side walls, and with a bottom portion of said filter element secured to said boss, said second chamber being located externally of said first chamber, and said first chamber being at least partially defined by the cavity of said filter element;

a beverage medium received in said cavity for storage in said first chamber; and a cover joined to said rim and closing said upper opening, said cover being piercable to accommodate an inflow of liquid into said first chamber for combination with the beverage medium to produce a beverage, said filter element being permeable to accommodate a flow of said beverage from said first chamber into said second chamber, and said bottom being piercable to accommodate an outflow of said beverage from said second chamber to the exterior of said cartridge.

* * * * *